US008360223B2

(12) United States Patent
Iwatsuki et al.

(10) Patent No.: US 8,360,223 B2
(45) Date of Patent: Jan. 29, 2013

(54) MEDIUM STORING AND ADVANCING APPARATUS

(75) Inventors: Kei Iwatsuki, Gunma (JP); Kentaro Kamagata, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 221 days.

(21) Appl. No.: 12/737,084

(22) PCT Filed: Apr. 16, 2009

(86) PCT No.: PCT/JP2009/057684

§ 371 (c)(1),
(2), (4) Date: Dec. 7, 2010

(87) PCT Pub. No.: WO2009/154036

PCT Pub. Date: Dec. 23, 2009

(65) Prior Publication Data

US 2011/0079675 A1 Apr. 7, 2011

(30) Foreign Application Priority Data

Jun. 19, 2008 (JP) ..... 2008-160912

(51) Int. Cl.
*G07F 7/04* (2006.01)
*B65H 39/14* (2006.01)
*B65H 75/08* (2006.01)

(52) U.S. Cl. ..... 194/206; 242/613.1; 242/528

(58) Field of Classification Search ..... 194/206, 194/342, 343, 353; 242/160.1, 364.1, 366.4, 242/520, 613, 613.1, 528
See application file for complete search history.

(56) References Cited

U.S. PATENT DOCUMENTS

| | | | |
|---|---|---|---|
| 5,064,074 | A | 11/1991 | Edin et al. |
| 6,969,064 | B2 | 11/2005 | Ichikawa et al. |
| 7,469,822 | B2 | 12/2008 | Razzaboni et al. |

FOREIGN PATENT DOCUMENTS

| | | | | |
|---|---|---|---|---|
| CN | 1573820 | A | | 2/2005 |
| CN | 1759421 | A | | 4/2006 |
| GB | 2 134 493 | A | | 8/1984 |
| JP | 03-128854 | A | | 5/1991 |
| JP | 08-67382 | A | * | 3/1996 |
| JP | 08-067382 | A | | 3/1996 |
| JP | 2006-154973 | A | | 6/2006 |

* cited by examiner

*Primary Examiner* — Mark Beauchaine
(74) *Attorney, Agent, or Firm* — Rabin & Berdo, P.C.

(57) ABSTRACT

A medium storing and advancing apparatus is provided which prevents, when a medium sandwiched between two tapes is wound on a drum to be stored, that the medium could not be wound due to the thickness of the tapes wound previously on the drum. The medium storing and advancing apparatus includes reels which supply and wind up the tapes, and a drum which winds up the tapes, wherein the drum is provided with a drum groove portion over the circumferentially entire periphery substantially in a middle way of the outer peripheral surface of the drum so that the tapes are wound in the drum groove portion.

7 Claims, 5 Drawing Sheets

MEDIUM STORING AND ADVANCING APPARATUS

TECHNICAL FIELD

The present invention relates to a medium storing and advancing apparatus which stores and feeds out a medium such as a bill, a check, or securities by winding up and rewinding tapes wound on a drum and reels, and more particularly to a bill depositing and withdrawing machine, a check/securities retrieving and issuing machine, or a bill/check/securities receiving and delivering apparatus.

BACKGROUND ART

In a conventional medium storing and advancing apparatus, as described in Japanese patent laid-open publication No. 67382/1996, when storing a bill, the bill incoming from a bill insertion and discharge slot is sandwiched by two tapes, and those tapes are wound up by a drum on which the end portions of the two tapes are wound, and the bill is wound up along with the tapes on the drum to be stored.

In the initial state of the medium storing and advancing apparatus, since the tapes are already wound by a predetermined number of rounds on the drum surface, a step is formed between the surface of the drum and the outer peripheral surface of the tapes wound on the drum due to the thickness of the tapes wound on the drum. In the case where bills are stored in the medium storing and advancing apparatus in such a state, the bills are deformed into a V shape due to the step as is wound on the drum. Therefore, there is the problem that the bills maybe folded along the process of storing them, and, depending on their folding way, the pull force of the tapes surrenders to the unflexibility of the folded bill, which results in a difficulty in appropriately winding the bills onto the drum.

SUMMARY OF THE INVENTION

It is an object of the present invention to provide a medium storing and advancing apparatus in which such a disadvantage in the conventional technique is overcome to be able to prevent the deformation of bills when winding up them onto a drum.

In accordance with the medium storing and advancing apparatus according to the present invention, the drum has a tape wind-up track part. The track part is a groove provided over the entire periphery in the outer peripheral surface of the drum, and the groove renders a difference in level between the surface of the drum and the outer peripheral surface of the tapes wound on the drum to be reduced, which makes it possible to prevent a medium sandwiched by the two tapes from being deformed into a V shape that would be caused by the level difference between the surface of the drum and the tapes at the start of storage of bills. It is therefore possible to prevent that when the medium is folded the pull force of the tapes surrenders to the unflexibility of the medium, which would result in a difficulty in winding the bill on the drum in an orderly fashion.

Further, in accordance with the present invention, the diameter of the tape wind-up track part is determined on the basis of an area of the stepwise portion between the outer diameter of the drum and the drum wind-up track part, as well as the thickness of the tapes to be wound on the drum. That makes it possible to even out the thickness of the layers of the tapes wound on the drum in the initial state at the start of storage of the bill to the height from the bottom surface of the tape wind-up track part to the drum surface. Therefore, when starting storage of bills and the first bill to be stored is then wound on the drum, it is possible to prevent the bill from being deformed into a V shape.

In accordance with the present invention, even when a bill is wound on the drum while having the tapes wound in a small amount thereon so that a part of the bill gets into the tape wind-up track part, it is possible to prevent the bill from being deformed into a V shape to be folded, which makes it possible to securely wind the bills on the drum.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Embodiments of a medium storing and advancing apparatus according to the present invention will be described in detail with reference to the accompanying drawings.

Figure 1:
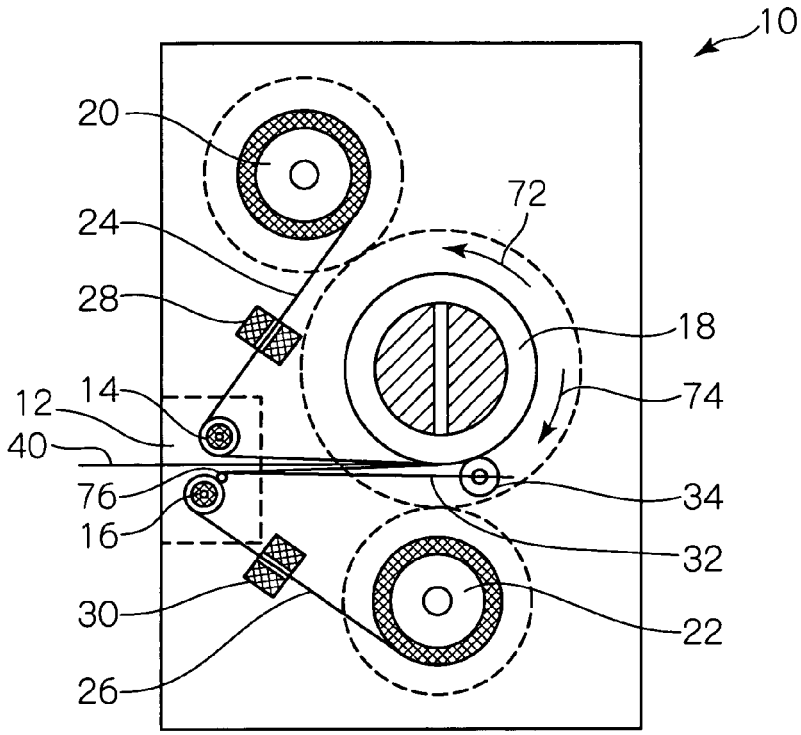
FIG. 1 is a schematic side view showing the main part of a medium storing and advancing apparatus according to an embodiment of the present invention.

FIG. 1 schematically shows the main part of the medium storing and advancing apparatus according to an embodiment of the present invention in a side view. In the embodiment shown in FIG. 1, the medium storing and advancing apparatus 10 is adapted to store and feed out bills conveyed to the medium storing and advancing apparatus 10 by, for example, a conveyor unit or the like. As shown in FIG. 1, the medium storing and advancing apparatus 10 comprises a bill insertion and discharge slot 12, idlers 14 and 16, a drum 18, and reels 20 and 22 disposed above and under the drum 18, respectively. On the drum 18, one end portions of tapes 24 and 26 are wound, while onto the reels 20 and 22 wound are the other end portions of the tapes 24 and 26 respectively coming via the idlers 14 and 16. The medium storing and advancing apparatus 10 further comprises tape end sensors 28 and 30, a movable guide 32, and driven rollers 34.

The bill insertion and discharge slot 12 is adapted to receive a bill 40 conveyed from the conveyor unit, not shown, arranged outside the medium storing and advancing apparatus, or discharge the bill 40 to the conveyor unit. The bill 40 is inserted between the idlers 14 and 16, i.e. between the tapes 24 and 26, or discharged from between the tapes 24 and 26.

The drum 18 is adapted to wind or unwind the tapes 24 and 26 to store or draw out the bill along with the tapes. The tapes 24 and 26 thereby convey the bill received from the insertion and discharge slot 12 to the drum 18 while the drum rotates, or convey the bill stored in the apparatus 10 to the insertion and discharge slot 12 while the drum rotates.

Figure 2:
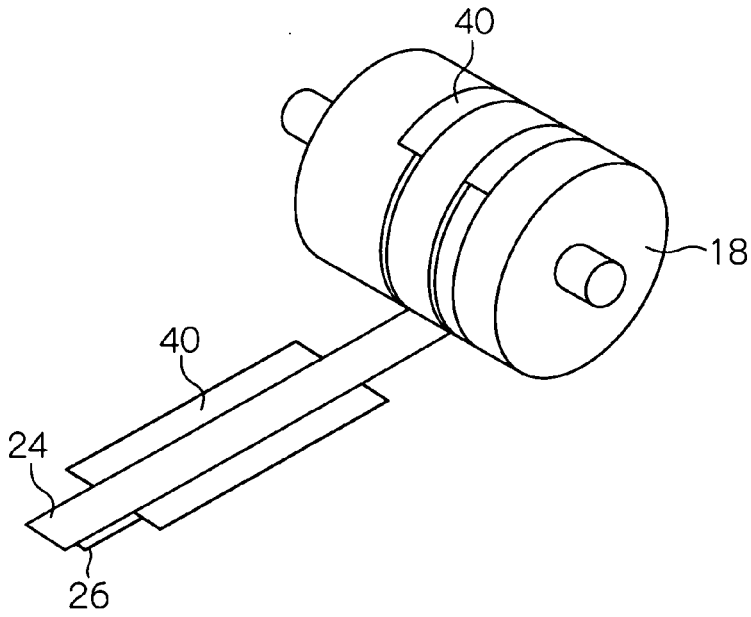
FIG. 2 is a schematic perspective view showing how the drum of the embodiment of FIG. 1 winds bills on itself.

FIG. 2 shows how the drum is winding the bills on itself. As shown in FIG. 2, when the bill 40 conveyed from the insertion and discharge slot 12 is stored in the apparatus 10, the drum 18 is caused to rotate in a direction of winding up the tapes 24 and 26, thereby the bill 40 sandwiched by the two tapes 24 and 26 being wound on the drum 18 to be stored.

Figure 3:
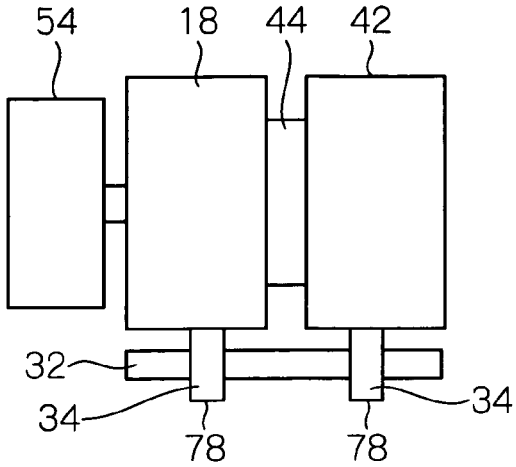
FIG. 3 is a schematic front view showing the drum of the embodiment of FIG. 1 on which no tapes are wound.

FIG. 3 is a front view of the drum 18 on which no tapes are wound. In the drum 18 of the present embodiment, a drum groove portion 44 is formed substantially in the middle way in the axial direction of the drum over the circumferentially entire periphery, and the drum groove portion 44 is shorter in diameter than the outer peripheral surface 42 of the drum. Thus, the drum outer peripheral surface 42 has its central portion formed concave. The tapes 24 and 26 are wound in the drum groove portion 44.

Figure 4:
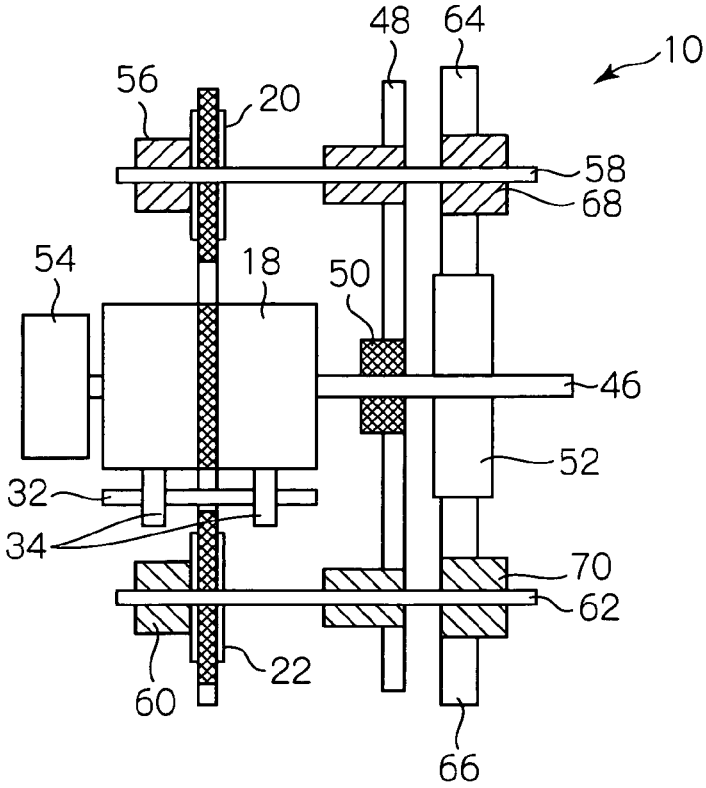
FIG. 4 is a schematic front view showing the main part of the medium storing and advancing apparatus in the embodiment of FIG. 1.

The drum 18 is adapted to rotate about a rotation axis served by a drum shaft 46. The drum shaft 46 is, as shown in FIG. 4, mounted on a frame 48 of the medium storing and advancing apparatus via a bearing 50 so that the drum shaft 46 is rotatable with respect to the frame 48. The drum shaft 46 rotates by, for example, a driving motor, not shown, thereby causing the drum 18 to rotate.

The drum shaft 46 is equipped with a drum gear 52 so that the drum gear 52 transmits the rotation of the drum shaft 46 to the reels 20 and 22.

Further, the drum shaft 46 has an operation knob 54 fixed so that an operator or the like can manually turn the operation knob 54 to cause the drum 18 to rotate together with the drum shaft 46.

The reels 20 and 22 are adapted to wind up the tapes 24 and 26 while the drum shaft 46 rotates. The reel 20 is equipped with a reel shaft 58 via a torque limiter 56 and the reel 22 is equipped with a reel shaft 62 via a torque limiter 60.

As shown in FIG. 4, the reel shafts 58 and 62 are mounted on the frame 48. The reel shafts 58 and 62 are respectively equipped with reel gears 64 and 66 via one-way clutches 68 and 70. Since the reel gears 64 and 66 engage with the drum gear 52, when the drum shaft 46 rotates to cause the drum gear 52 to rotate, the reel gears 64 and 66 as well rotate while the drum gear rotates.

The one-way clutches 68 and 70 are adapted to transmit the rotation in predetermined directions of the reel gears 64 and 66 to the reel shafts 58 and 62. Specifically, in the case where the drum shaft 46 causes the drum 18 to rotate in the direction of winding up the tapes 24 and 26, i.e. a direction shown by an arrow 72 in FIG. 1, even though the rotation of the drum shaft 46 causes the reel gears 64 and 66 to rotate, the one-way clutches 68 and 70 run idle so as not to transmit the rotation of the drum shaft 46 to the reel shafts 58 and 62. By contrast, in the case where the drum shaft 46 causes the drum 18 to rotate in the direction of unwinding the tapes 24 and 26, i.e. a direction shown by an arrow 74 in FIG. 1, the one-way clutches 68 and 70 respectively transmit the rotation of the reel gears 64 and 66 to the reel shafts 58 and 62, and the reel shafts 58 and 62 respectively rotate in the directions of winding up the tapes 24 and 26.

The tape end sensors 28 and 30 are adapted for figuring out how much the tapes 24 and 26 are wound on the drum 18 and the reels 20 and 22.

In the present embodiment, the sensors 28 and 30 are optical sensors, each of which has a light-emitter and a light-sensor. Each of the sensors 28 and 30 is configured such that the tape 24 or 26 runs between the light-emitter and light-sensor thereof, and is arrayed in the vicinity of the reel 20 or 22 so as not to touch the tape 24 or 26. The tapes 24 and 26 in the present embodiment are made of transparent material which can transmit light. Meanwhile, the tape 24 has its predetermined length of each end portion colored for shielding light on the side to be wound on the drum, the predetermined length corresponding, for example, to 100 rounds by which the tape is allowed to be wound. In the same way, the tape 26 has its predetermined length of each end portion colored for shielding light on the side to be wound on the reel 22. Hereinafter, the lengths of end portions thus colored for shielding light will be called light shielding parts.

The sensor 28 is capable of sensing that the tape 24 wound on the drum 18 is running out, i.e. the tail end portion of the tape 24 is close when light from the light-emitter of the sensor 28 is shielded by the light shielding part of the tape 24 so as not to be caught by the light-sensor. Further, the sensor 30 is capable of sensing that the tape 26 wound on the reel 22 is running out when light from the light-emitter of the sensor 30 is shielded by the light shielding part of the tape 26 so as not to be caught by the light-sensor.

The movable guide 32 is arrayed under the drum to guide the lower surface of the medium 40 advancing to the drum. The guide has its end provided with a pivotal shaft 76, and is biased upward, i.e. toward the drum 18, by an elastic member, not shown. Therefore, when the medium 40 is wound on the drum 18, the guide 32 is pivoted and depressed down about the rotary shaft 76 to the extent corresponding to the thickness of the medium 40. The movable guide 32 is provided with two driven rollers 34.

Figure 5:
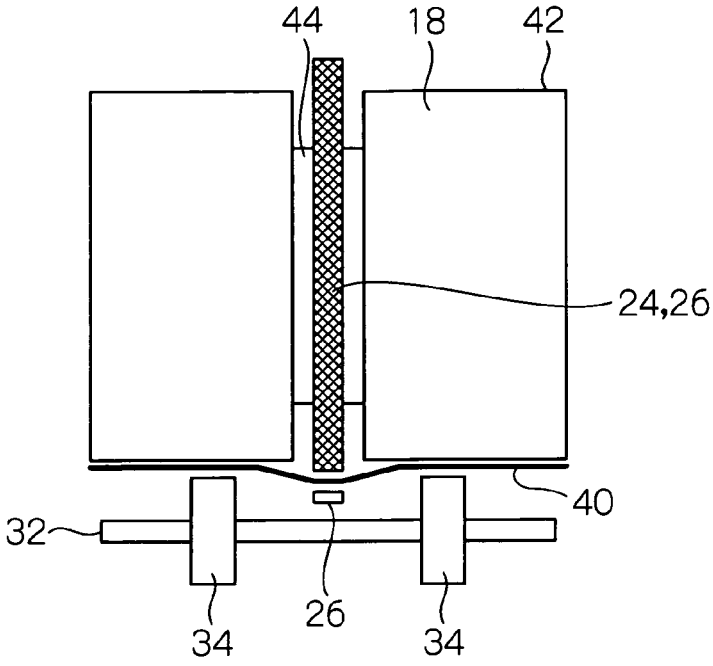
FIG. 5 is a schematic front view showing how the drum shown in FIG. 1 winds a bill on itself.

The driven rollers 34 are, as shown in FIG. 5, arrayed at the opposite sides of the tapes 24 and 26 wound on the drum so as not to touch the tapes 24 and 26, but to abut on the opposite ends of the bill when the bill 40 is wound on the drum. Since the driven rollers have the outer peripheral surfaces 78 get in contact with the drum outer peripheral surface 42 as shown in FIG. 3, the driven rollers are capable of being, driven to rotate while the drum 18 rotates.

Now, the operation of the medium storing and advancing apparatus 10 in the present embodiment will be described.

First, before the start of storage of the bill 40, the tapes 24 and 26 are wound up by the reels 20 and 22 until the tape end sensor 28 senses the light shielding part of the tape 24. When the tape sensor 28 senses the light shielding part of the tape 24, the winding-up is stopped.

Next, the winding-up of the tapes 24 and 26 by the drum 18 is started, and then the winding-up is stopped when the tape sensor 28 fails to sense the light shielding part of the tape 24, thereby achieving a state which is considered as an initial state at the start of storage of bills. In this state, it is assumed that the tapes 24 and 26 are wound in the drum groove portion 44 by a predetermined number of rounds, for example, approximately 100 rounds.

The bill 40 is conveyed from the bill insertion and discharge slot 12 into the medium storing and advancing apparatus 10, and is inserted between the tapes 24 and 26. When the medium storing and advancing apparatus 10 proceeds to its storage operation, the drum 18 is caused to rotate in the tape wind-up direction 72 by the driving motor. The bill 40 is thereby sandwiched by the tapes 24 and 26 to be wound up by the drum 18 and stored in the apparatus 10.

At this time, the one-way clutches 68 and 70 do not transmit the rotation of the drum 18 to the reels 20 and 22. Meanwhile, since the reels 20 and 22 are pulled by the tapes 24 and 26 to rotate, tension is always applied to the tapes 24 and 26.

In accordance with the present embodiment, since the drum groove portion 44 of the drum 18 is concave with respect to the drum outer peripheral surface 42, even when the tapes 24 and 25 are wound by the predetermined number of rounds in the drum groove portion 44, it is possible to suppress the level difference between a tape outer peripheral surface 106, which is formed due to the thickness of the tapes wound in the drum groove portion 44, and the drum outer peripheral surface 42. Since the level difference is thus reduced, it is possible to lower an extent to which the bill sandwiched by the two tapes would otherwise be deformed into a V shape by the level difference between the surface of the drum and the tapes at the start of storage of bills. It is therefore possible to prevent that the bill is folded and the pull force of the tapes surrenders to the unflexibility of the medium, which would result in a difficulty in winding the media on the drum in an orderly fashion.

Figure 6:
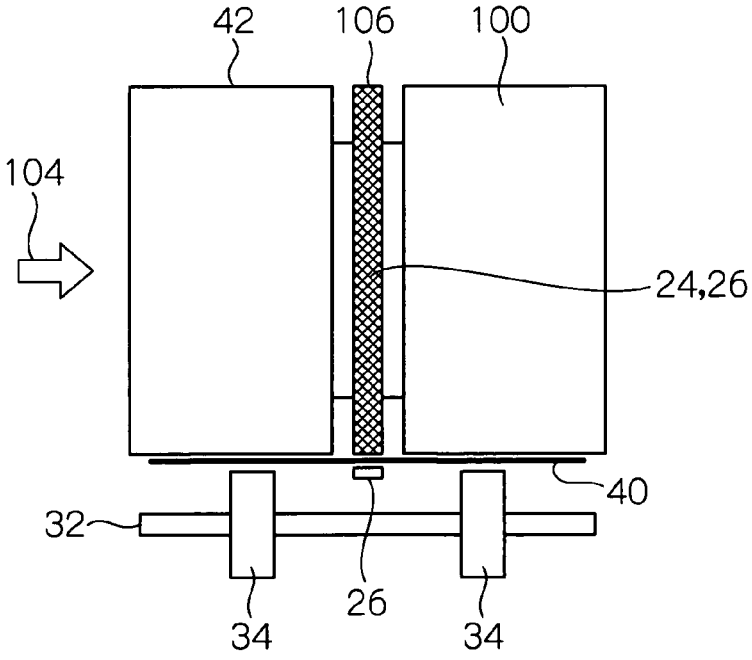
FIG. 6 is a schematic front view showing a drum in an alternative embodiment of the medium storing and advancing apparatus according to the present invention.

An alternative embodiment of the medium storing and advancing apparatus according to the present invention will be described with reference to FIG. 6. The configuration of the medium storing and advancing apparatus in the embodiment shown in FIG. 6 is the same as the apparatus shown in FIG. 1 other than the diameter of a drum 100 and the dimensions of its groove portion which are determined on the basis of the thicknesses of the tapes 24 and 26. In addition, portions like those in the above-described embodiment are denoted by the same reference numerals, and descriptions thereof will not be repeated.

Figure 7:
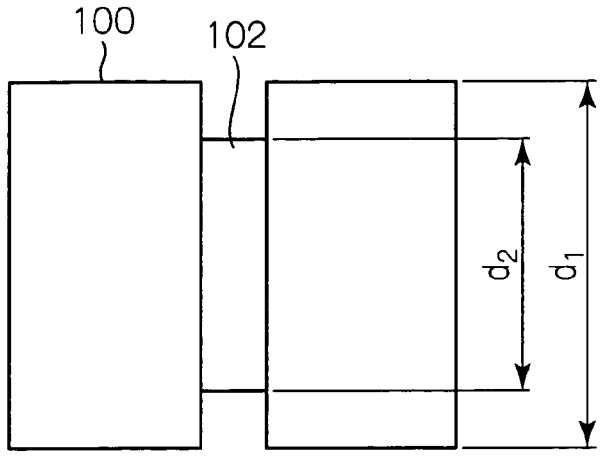
FIG. 7 is an explanatory view showing the outer diameter of the drum and the diameter of the drum groove portion shown in FIG. 6.

FIG. 6 shows the drum in its initial state at the start of storage of bills, and the tapes 24 and 26 are wound by a predetermined number of rounds in a drum groove portion 102. As shown in FIG. 6, in the initial state, the outer diameters of the drum and the tapes wound on the drum are equal to each other. More specifically, in the embodiment shown in FIG. 6, the diameter of the drum groove portion 102 is determined as follows. That is, as shown in FIG. 7, the outer diameter of the drum 100 is set as d1 and the diameter of the drum groove portion 102 is set as d2. Moreover, the thicknesses of the tapes 24 and 26 are set as t1 and t2, respectively, and the lengths of the tapes 24 and 26 wound on the drum 100 in the initial state are respectively set as a1 and a2. Here, given that the cross-sectional areas of the tapes 24 and 26 when viewed from the direction of an arrow 104 in FIG. 6 are respectively S1 and S2, those are expressed as $$S1=a1\times t1;\text{ and}$$

$$S2=a2\times t2.$$

Moreover, the cross-sectional area S3 of the stepwise portion between the outer diameter d1 of the drum 100 and the drum groove portion 102 are expressed as $$S3=\pi\times(d1/2)\times(d1/2)-\pi\times(d2/2)\times(d2/2).$$

Then, the diameter d2 of the drum groove portion 102 is defined so as to satisfy S3=S1+S2.

In this way, the diameter d2 of the drum groove portion 102 is determined on the basis of the area of the stepwise portion between the drum outer peripheral surface 42 and the drum groove portion 102 as well as the cross-sectional areas of the tapes 24 and 26 wound on the drum, so that the diameter d2 may be determined according to the thickness of the layers of the tapes 24 and 26 wound on the drum 102, which makes it possible to adjust that the outer peripheral surface 106 of the tapes 24 and 26 wound in the drum groove portion 102 and the drum outer peripheral surface 42 are at substantially the same level at the start of storage of bills.

In another alternative embodiment, the drum may be configured to prevent bills from being folded with a shape of its groove ends between the drum outer peripheral surface and the drum groove portion. A drum 200 shown in FIG. 8 has groove ends 202 formed into taper shape.

Herein, in the medium storing and advancing apparatus according to the present invention, the tapes 24 and 26 are repeatedly wound on the drum or unwound from the drum for storing and feeding out the bill 40. Therefore, the bill maybe wound on the drum when having the tapes 24 and 26 wound in a small amount in the drum groove portion. In this case, a part of the bill gets into the drum groove portion to be deformed into a substantially V shape.

Figure 8:
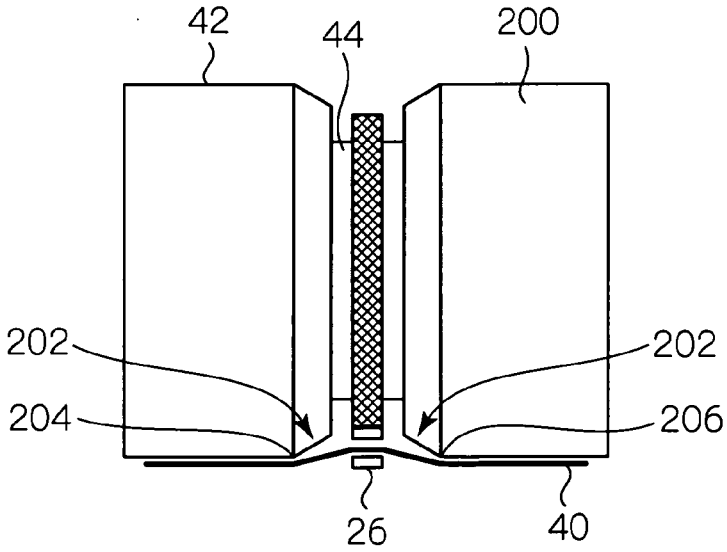
FIG. 8 is a schematic front view showing a drum in another alternative embodiment of the medium storing and advancing apparatus according to the present invention.

However, since the groove ends 202 are formed into taper shape in the embodiment shown in FIG. 8, the bill 40 wound on the drum 200 when having the tapes wound in a small amount thereon touches the drum 200 at contact points 204 and 206 shown in FIG. 8. It is thus possible to enlarge the distances between the contact points and the portions sandwiched by the tapes 24 and 26 as compared with the case where the drum without such groove ends are used. That allows a bill to be wound on the drum, when the tapes are wound in a small amount, to minimize deformation of the bill without rendering the bill to be folded, thus ensuring bills to be wound onto the drum.

Figure 9:
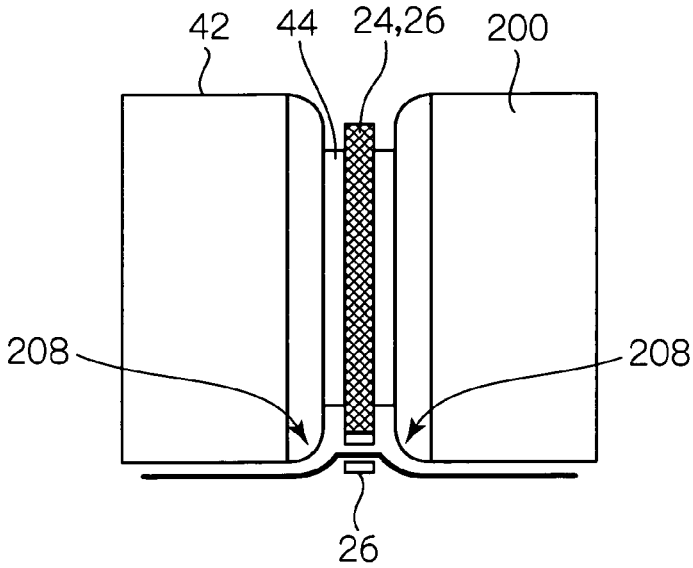
FIG. 9 is a schematic front view showing a drum in a further alternative embodiment of the medium storing and advancing apparatus according to the present invention.

Further, as shown in FIG. 9, the corners formed by the side surfaces of the drum groove portion and the drum outer peripheral surface are chamfered to be round so that the groove ends 208 may have curved surfaces formed into arc shapes.

That allows the bill, even when wound on the drum to partially get into the drum groove portion, to be deformed along the roundness of the groove ends 208. It is, therefore, possible to prevent the bill from having a fold line, and the bill is less subject to being damaged.

In a further alternative embodiment, the bill is prevented from being deformed by enlarging the width of the drum groove portion. In the embodiment shown in FIG. 10, a drum 300 has a drum groove portion 302 whose width is larger than that of the drum groove portion 44 of the drum 18 shown in FIG. 5, and is substantially equal to the distance of opposed surfaces 304 and 306 of the driven rollers 34.

Figure 10:
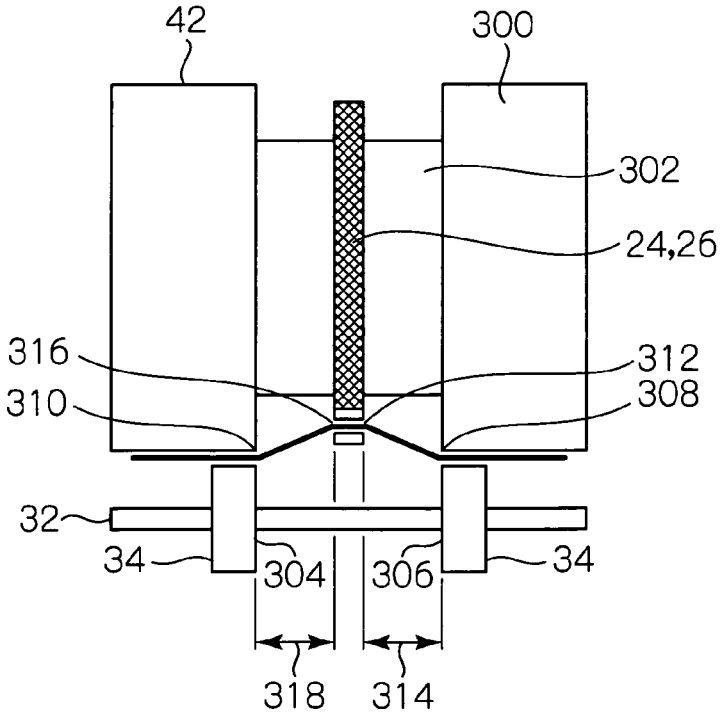
FIG. 10 is a schematic front view showing a drum in a still other alternative embodiment of the medium storing and advancing apparatus according to the present invention.

In that case, when the bill 40 is wound on the drum 300 when having the tapes 24 and 26 wound in a small amount to be deformed into a V shape, the bill is in contact with the drum 300 at the contact points 308 and 310 shown in FIG. 10. It is thus possible to enlarge both the distance 314 between the one contact point 308 of the bill and one end 312 at the side of the contact point 308 of the portion sandwiched by the tapes 24 and 26, and the distance 318 between the other contact point 310 of the bill 40 and another end 316 at the side of the contact point 310 of the portion sandwiched by the tapes 24 and 26. That makes it possible to lower an extent to which the bill is folded, and to ensure bills to be wound on the drum even when having the tapes wound in a small amount.

The respective embodiments are described above as examples which are configured to include the two tapes and the two reels. Meanwhile, it goes without saying that the same advantages may be attained in the case where the present invention is applied to a medium storing and advancing apparatus having the configuration in which a single tape and a single reel are provided.

The entire disclosure of Japanese patent application No. 2008-160912 filed on Jun. 19, 2008, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

The invention claimed is:

1. A medium storing and advancing apparatus comprising reels which supply or wind up tapes, and a drum which winds up the tapes supplied from said reels, said apparatus storing a medium by holding the medium between the tapes being wound up by said drum, or drawing out the medium held between the tapes by winding up the tapes by said reels to unwind the tapes from said drum, wherein said drum is provided with a groove portion over a circumferentially entire periphery substantially in a middle way in an axial direction of said drum so that the tapes are wound in said groove portion.

2. The medium storing and advancing apparatus in accordance with claim 1, wherein an outer diameter of the tapes wound in said groove portion in advance at a start of storage of the medium substantially equals an outer diameter of said drum.

3. The medium storing and advancing apparatus in accordance with claim 1, wherein said groove portion is formed so as to suppress deformation of the medium which would otherwise be formed due to a difference in level between an outer peripheral surface of said drum and an outer peripheral surface of the tapes wound on said drum even when the medium is wound on said drum, when having the tapes wound in a small amount thereon, through said drum repetitively winding up and unwinding the tapes.

4. The medium storing and advancing apparatus in accordance with claim 3, wherein a tapered surface is provided between the outer peripheral surface of said drum and a bottom surface of said groove portion.

5. The medium storing and advancing apparatus in accordance with claim 3, wherein a curved surface is provided between the outer peripheral surface of said drum and a bottom surface of said groove portion.

6. The medium storing and advancing apparatus in accordance with claim 3, further comprising:

two rollers driven to rotate while said drum rotates, and abutting on opposite ends of the medium to be wound on said drum, wherein said groove portion has a width substantially equal to a distance of inner side surfaces of said two driven rollers.

7. A medium storing and advancing apparatus comprising tapes, reels on which one end portions of said tapes are wound, and a drum on which other end portions of said tapes are wound, said apparatus storing a medium by winding up said tapes by said drum to wind up the medium together with said tapes, or drawing out the medium wound up by said drum by winding up said tapes by said reels, wherein said drum has a groove portion over a circumferentially entire periphery substantially in a middle way in an axial direction of an outer periphery surface thereof so that said tapes are wound in said groove portion.

* * * * *